US011131319B2

(12) United States Patent
Nakaniwa et al.

(10) Patent No.: US 11,131,319 B2
(45) Date of Patent: Sep. 28, 2021

(54) CENTRIFUGAL COMPRESSOR

(71) Applicant: MITSUBISHI HEAVY INDUSTRIES COMPRESSOR CORPORATION, Tokyo (JP)

(72) Inventors: Akihiro Nakaniwa, Tokyo (JP); Akinori Tasaki, Hiroshima (JP); Daisuke Hirata, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 353 days.

(21) Appl. No.: 16/117,673

(22) Filed: Aug. 30, 2018

(65) Prior Publication Data

US 2019/0063457 A1 Feb. 28, 2019

(30) Foreign Application Priority Data

Aug. 31, 2017 (JP) ..... JP2017-167059

(51) Int. Cl.
*F04D 17/12* (2006.01)
*F04D 29/44* (2006.01)
(Continued)

(52) U.S. Cl.
CPC ..... *F04D 29/441* (2013.01); *F04D 1/06* (2013.01); *F04D 17/122* (2013.01); *F04D 29/286* (2013.01); *F05B 2240/12* (2013.01)

(58) Field of Classification Search
CPC ..... F04D 29/441; F04D 17/122; F04D 1/06; F04D 29/286; F05B 2240/12
See application file for complete search history.

(56) References Cited

U.S. PATENT DOCUMENTS 1,669,581 A * 5/1928 Spencer ..... F04D 29/4233 415/204
3,060,335 A * 10/1962 Greenwald ..... H02K 9/19 310/54
(Continued)

FOREIGN PATENT DOCUMENTS

JP 2014-206132 A 10/2014
JP 2016-180400 A 10/2016
(Continued)

OTHER PUBLICATIONS

The Office Action dated Apr. 20, 2021, issued in counterpart JP application No. 2017-167059 (10 pages).

*Primary Examiner* — Woody A Lee, Jr.
*Assistant Examiner* — Brian Christopher Delrue
(74) *Attorney, Agent, or Firm* — Osha Bergman Watanabe & Burton LLP

(57) ABSTRACT

A centrifugal compressor is provided with a plurality of diaphragms including a first diaphragm and a second diaphragm which are adjacent to each other in an axial direction, a casing disposed on a radially outer side of the plurality of diaphragms and accommodating an internal component including the plurality of diaphragms, at least one axial spacer disposed between the first diaphragm and the second diaphragm, and a scroll flow passage formed by a scroll inner peripheral wall and a scroll outer peripheral wall. The scroll inner peripheral wall is formed by a surface of the first diaphragm positioned on a radially inner side of an outer peripheral surface of the first diaphragm. At least a part of the scroll outer peripheral wall is formed by an inner peripheral surface of the casing.

8 Claims, 6 Drawing Sheets

(51) Int. Cl.
*F04D 1/06* (2006.01)
*F04D 29/28* (2006.01)

(56) References Cited

U.S. PATENT DOCUMENTS 3,355,878 A * 12/1967 Birmann ..... F02C 6/12 60/316
3,584,973 A * 6/1971 Lambiris ..... F01D 25/22 417/13
4,311,004 A * 1/1982 du Pont ..... F04D 29/104 415/175
5,312,225 A * 5/1994 Lorenzen ..... F04D 29/058 415/105
6,043,580 A * 3/2000 Vogel ..... F04D 25/0606 310/179
6,231,302 B1 * 5/2001 Bonardi ..... F01D 25/22 415/105
6,451,095 B1 * 9/2002 Keefer ..... B01D 53/0431 96/125
6,558,117 B1 * 5/2003 Fukaya ..... F02B 37/24 415/164
6,905,535 B2 * 6/2005 Keefer ..... B01D 53/047 95/101
7,089,664 B2 * 8/2006 Ohishi ..... F01D 17/165 29/889.7
8,061,976 B2 * 11/2011 Hall ..... F04D 29/462 415/160
8,147,186 B2 * 4/2012 Ibaraki ..... F04D 29/441 415/148
9,017,017 B2 * 4/2015 Sausse ..... F01D 17/165 415/160
9,399,923 B2 * 7/2016 Brinkert ..... F01D 9/026
9,556,882 B2 * 1/2017 Heidingsfelder ..... F02C 9/22
10,066,638 B2 * 9/2018 Bessho ..... F04D 29/681
10,197,063 B2 * 2/2019 Nakaniwa ..... F04D 29/444
10,227,889 B2 * 3/2019 Arnold ..... F02B 37/025
10,330,102 B2 * 6/2019 Ishikawa ..... F04D 17/10
10,662,870 B2 * 5/2020 Wang ..... F02B 37/183
2002/0023575 A1 * 2/2002 Gatley, Jr. ..... F01D 25/24 110/182
2003/0230085 A1 * 12/2003 Sumser ..... F02M 26/05 60/602
2004/0096317 A1 * 5/2004 Scholz ..... F01D 17/165 415/160
2005/0005603 A1 * 1/2005 Stilgenbauer ..... F01D 17/165 60/602
2006/0016188 A1 * 1/2006 Kennedy ..... F02D 41/0007 60/605.2
2007/0212238 A1 * 9/2007 Jacobsen ..... F04D 29/058 417/423.1
2007/0269323 A1 * 11/2007 Zhou ..... F04D 29/584 417/423.7
2008/0115527 A1 * 5/2008 Doty ..... H02K 1/32 62/498
2009/0060719 A1 * 3/2009 Haugen ..... F02M 26/10 415/145
2009/0301085 A1 * 12/2009 Heyes ..... F04D 29/4213 60/611
2010/0008766 A1 * 1/2010 Scholz ..... F01D 17/165 415/160
2010/0154415 A1 * 6/2010 Ehrhard ..... F01D 17/165 60/605.1
2011/0008186 A1 * 1/2011 Palomba ..... F04D 29/059 417/247
2011/0067397 A1 * 3/2011 Hirth ..... F02M 26/05 60/602
2012/0107143 A1 * 5/2012 Gilarranz ..... F04D 29/104 417/53
2012/0159946 A1 * 6/2012 Sauerstein ..... F02B 37/025 60/598
2012/0306206 A1 * 12/2012 Agrawal ..... F01D 15/10 290/52
2013/0091869 A1 * 4/2013 Bardon ..... F25J 1/0279 62/6
2013/0136629 A1 * 5/2013 Maier ..... F04D 29/584 417/366
2013/0195609 A1 * 8/2013 Mariotti ..... F04D 17/122 415/1
2013/0294939 A1 * 11/2013 Gilarranz ..... F04D 25/0606 417/53
2014/0020393 A1 * 1/2014 Nakamata ..... F23R 3/002 60/754
2015/0064026 A1 * 3/2015 Maier ..... F04D 25/0606 417/53
2016/0017888 A1 * 1/2016 Nakaniwa ..... F04D 29/4206 415/203
2016/0025044 A1 * 1/2016 Martinez-Botas ..... F02B 37/24 60/605.2
2016/0090991 A1 * 3/2016 Devitt ..... F16J 15/3404 416/174
2016/0146100 A1 * 5/2016 Sun ..... F01D 17/165 415/1
2016/0186570 A1 * 6/2016 Lugg ..... F01D 5/34 416/3
2016/0230585 A1 * 8/2016 Arnold ..... F02B 37/025
2016/0290345 A1 * 10/2016 Palomba ..... F04D 25/0606
2018/0017073 A1 1/2018 Yamada
2018/0135647 A1 5/2018 Okada et al.
2019/0063457 A1 * 2/2019 Nakaniwa ..... F04D 29/441
2020/0173495 A1 * 6/2020 Peterson ..... F16C 43/02
2020/0271130 A1 * 8/2020 Miyata ..... F04D 29/5826

FOREIGN PATENT DOCUMENTS

WO 2016-120984 A1 8/2016
WO 2016-185592 A1 11/2016
WO WO-2018003632 A1 * 1/2018 ..... F02B 39/00
WO WO-2019207950 A1 * 10/2019 ..... F04D 29/44

* cited by examiner

CENTRIFUGAL COMPRESSOR

TECHNICAL FIELD

The present disclosure relates to a centrifugal compressor.

BACKGROUND ART

As an example of a conventional centrifugal compressor, Patent Document 1 discloses a centrifugal compressor including multiple stages of impellers arranged in an axial direction and a plurality of diaphragms disposed on a radially outer side of the impellers.

This type of centrifugal compressor has a scroll flow passage communicating with a discharge port. The scroll flow passage generally has an inner peripheral wall formed by an outer peripheral surface of a diaphragm on the discharge side and an outer peripheral wall formed by an inner peripheral surface of an annular spacer disposed between the diaphragm and a diaphragm axially adjacent thereto.

CITATION LIST

Patent Literature

Patent Document 1: 2016-180400A

SUMMARY

Reducing fluid loss in a scroll flow passage is important for reducing loss in a compressor.

However, when an inner peripheral wall of the scroll flow passage is formed by a surface of a first diaphragm, and an outer peripheral wall of the scroll flow passage is formed by an inner peripheral surface of an annular spacer as in a conventional centrifugal compressor, it is difficult to ensure a sufficient flow passage area of the scroll flow passage while avoiding an increase in size of the compressor; friction loss is relatively increased with an increase in scroll cross-sectional flow rate.

In view of this, it is required to reduce more fluid loss in the scroll flow passage than ever.

In view of the above, an object of at least one embodiment of the present invention is to provide a centrifugal compressor whereby it is possible to reduce fluid loss in a scroll flow passage while avoiding an increase in size of a compressor.

(1) A centrifugal compressor according to at least one embodiment of the present invention comprises: a plurality of diaphragms including a first diaphragm and a second diaphragm which are adjacent to each other in an axial direction; a casing disposed on a radially outer side of the plurality of diaphragms and accommodating an internal component including the plurality of diaphragms; at least one axial spacer disposed between the first diaphragm and the second diaphragm; and a scroll flow passage formed by a scroll inner peripheral wall and a scroll outer peripheral wall, the scroll inner peripheral wall being formed by a surface of the first diaphragm positioned on a radially inner side of an outer peripheral surface of the first diaphragm, at least a part of the scroll outer peripheral wall being formed by an inner peripheral surface of the casing.

With the above configuration (1), since at least a part of the scroll outer peripheral wall is formed by the inner peripheral surface of the casing, it is possible to enlarge a scroll flow passage area and reduce a scroll cross-sectional flow rate without increasing the casing, and it is possible to reduce friction loss in the scroll flow passage. Thus, it is possible to reduce fluid loss in the scroll flow passage while suppressing an increase in size of the centrifugal compressor.

(2) In some embodiments, in the above configuration (1), the at least one axial spacer includes a plurality of axial spacers disposed in a circumferential direction on a radially inner side of the inner peripheral surface of the casing.

With the above configuration (2), since the multiple axial spacers are disposed, in the circumferential direction, between the first diaphragm and the second diaphragm, it is possible to ensure positioning of the first diaphragm in the axial direction, relative to the second diaphragm.

(3) In some embodiments, in the above configuration (2), each of the axial spacers has a spacer inner peripheral surface facing the scroll inner peripheral wall, the spacer inner peripheral surface includes: an upstream contour portion adjoining the inner peripheral surface of the casing; and a downstream contour portion positioned downstream of the upstream contour portion in a scroll flow and connected to the upstream contour portion at a point located on a radially innermost portion of the axial spacer, and the scroll outer peripheral wall is formed by the spacer inner peripheral surface of each of the axial spacers and the inner peripheral surface of the casing.

In the above configuration (3), the scroll outer peripheral wall is formed by the inner peripheral surface of the casing and the spacer inner peripheral surface including an upstream contour portion adjoining the inner peripheral surface of the casing and a downstream contour portion connected to the upstream contour portion at a point located on a radially innermost portion of the axial spacer. That is, the scroll outer peripheral wall is formed so that the inner peripheral surface of the casing and the inner peripheral surface of the axial spacer are connected. Thus, it is possible to suppress turbulence of fluid in the scroll flow passage, compared with a case where the inner peripheral surface of the casing and the surface of the axial spacer is not connected. Consequently, it is possible to effectively reduce fluid loss in the scroll flow passage.

(4) In some embodiments, in the above configuration (3), the upstream contour portion includes: a first curved surface curved radially outward; and a second curved surface positioned downstream of the first curved surface in the scroll flow and curved radially inward.

In the above configuration (4), the upstream contour portion forming the scroll outer peripheral wall includes a first curved surface curved radially outward and a second curved surface positioned downstream of the first curved surface in the scroll flow and curved radially inward. Accordingly, the inner peripheral surface of the casing and the spacer inner peripheral surface forming the scroll outer peripheral wall are smoothly connected via the first curved surface and the second curved surface. Thus, it is possible to more effectively suppress turbulence of fluid in the scroll flow passage. Consequently, it is possible to more effectively reduce fluid loss in the scroll flow passage.

In some embodiments, in the above configuration (3) or (4), the downstream contour portion includes a straight-line portion extending obliquely with respect to a circumferential direction and radially outward downstream in the scroll flow.

With the above configuration (5), since the downstream contour portion includes a straight-line portion which extends obliquely with respect to the circumferential direction and radially outward downstream in the scroll flow, processing and manufacturing of the axial spacer can be easily controlled, and it is possible to suppress turbulence of fluid in the scroll flow passage. Thus, it is possible to reduce fluid loss in the scroll flow passage while improving manufacturability of the centrifugal compressor.

(6) In some embodiments, in any one of the above configurations (1) to (5), the centrifugal compressor further comprises at least one bolt for connecting the first diaphragm and the second diaphragm, and each of the axial spacers includes a bolt insertion hole for the at least one bolt.

In the above configuration (6), the bolt for connecting the first diaphragm and the second diaphragm is inserted into the bolt insertion hole of the axial spacer. Thus, the bolt disposed on the radially inner side of the inner peripheral surface of the casing to connect the diaphragms is covered with the axial spacer without being exposed to the scroll flow passage. Accordingly, the bolt itself does not cause turbulence of fluid flowing in the scroll flow passage. Consequently, it is possible to effectively reduce fluid loss in the scroll flow passage.

(7) In some embodiments, in any one of the above configurations (1) to (6), each of the axial spacers includes: a first fitting portion fitted into a first recess provided in the first diaphragm at one end; and a second fitting portion fitted into a second recess provided in the second diaphragm at another end.

In the above configuration (7), each of the axial spacers includes a first fitting portion fitted into a first recess provided in the first diaphragm and a second fitting portion fitted into a second recess provided in the second diaphragm. This facilitates positioning of each axial spacer in the circumferential direction or the radial direction around the axis.

(8) In some embodiments, in any one of the above configurations (1) to (7), the inner peripheral surface, forming the scroll outer peripheral wall, of the casing has a cylindrical shape whose axis is a rotational center of the centrifugal compressor.

With the above configuration (8), since the inner peripheral surface of the casing, which forms the scroll outer peripheral wall, has a cylindrical shape whose axis is the rotational center of the centrifugal compressor, the scroll flow passage can be easily formed by using the cylindrical inner peripheral surface.

At least one embodiment of the present invention provides a centrifugal compressor whereby it is possible to reduce fluid loss in a scroll flow passage while avoiding an increase in size of a compressor.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

Hereinafter, a multi-stage centrifugal compressor including multi-stage impellers will be described as an example of the centrifugal compressor.

Figure 1:
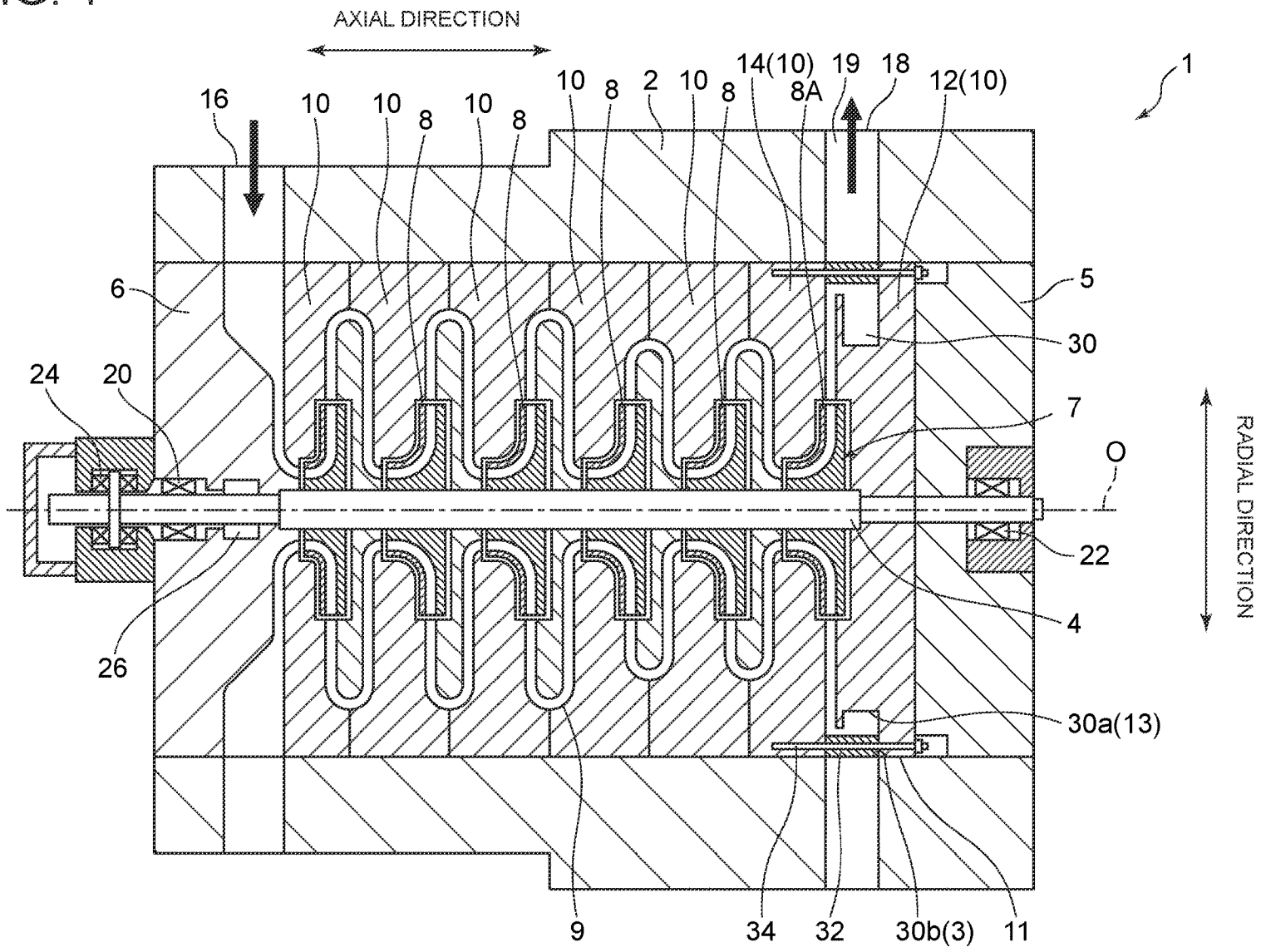
FIG. 1 is a cross-sectional view of a centrifugal compressor according to an embodiment, taken along I-I of FIG. 2.
Figure 2:
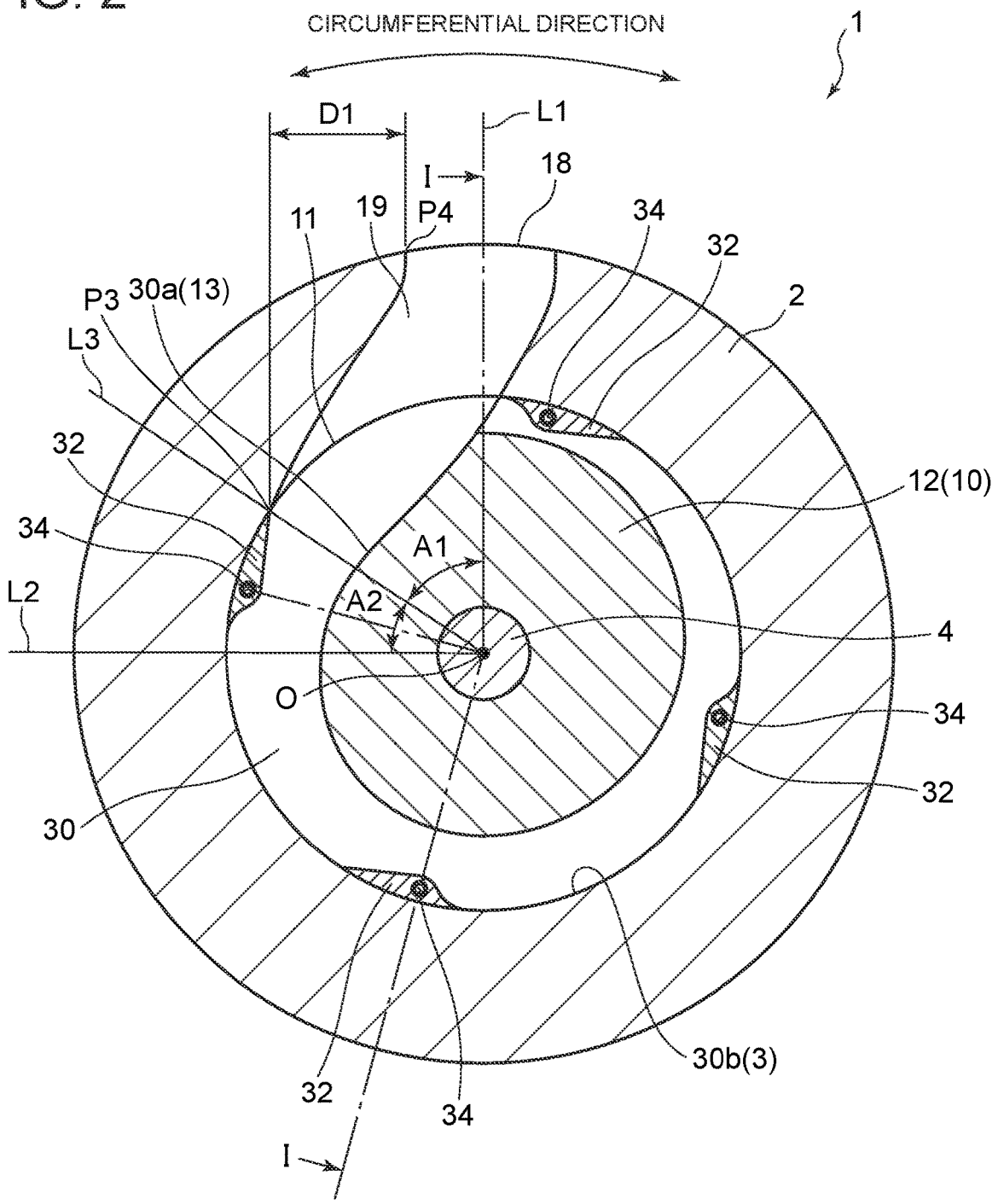
FIG. 2 is a cross-sectional view of a discharge port of a centrifugal compressor according to an embodiment, taken along the radial direction of the centrifugal compressor.

FIGS. 1 and 2 are cross-sectional views of a centrifugal compressor according to an embodiment. FIG. 2 is a cross-sectional view of a discharge port of the centrifugal compressor, taken along the radial direction. FIG. 1 is a cross-sectional view take along I-I of FIG. 2.

As shown in FIG. 1, the centrifugal compressor 1 includes a casing 2 and a rotor 7 rotatably supported within the casing 2. The rotor 7 includes a shaft 4 and multi-stage impellers 8 fixed to an outer surface of the shaft 4.

The casing 2 accommodates a plurality of diaphragms arranged in the axial direction. The diaphragms 10 are disposed so as to surround the impeller from the radially outer side. Additionally, casing heads 5, 6 are disposed on both axial sides of the diaphragms 10.

The rotor 7 is rotatably supported by radial bearings 20, 22 and a thrust bearing 24 so as to rotate around a rotational axis O.

The diaphragms 10 are one of internal components of the centrifugal compressor 1 accommodated in the casing 2. The internal components accommodated in the casing 2 also include, in addition to the diaphragms 10, the rotor 7 having impellers 8.

A first end of the casing 2 is provided with an intake port 16 through which a fluid enters from the outside, and a second end of the casing 2 is provided with a discharge port 18 for discharging the fluid compressed by the centrifugal compressor 1 to the outside. Inside the casing 2, a flow passage 9 is formed so as to connect the multi-stage impellers 8. The intake port 16 communicates with the discharge port 18 via the impellers 8 and the flow passage 9.

In the illustrated embodiment, the flow passage 9 inside the casing 2 is at least partially formed by the diaphragms 10.

As shown in FIGS. 1 and 2, a scroll flow passage 30, which is an annular flow passage with a flow-passage cross-sectional area changing along the circumferential direction, is formed between a last-stage impeller 8A disposed on the furthest downstream side among the multi-stage impellers 8 and the discharge port 18 of the casing 2. The scroll flow passage 30 and the discharge port 18 are connected via an outlet flow passage 19 formed in the casing 2.

A fluid which enters into the centrifugal compressor 1 thorough the intake port 16 flows from upstream to downstream thorough the multi-stage impellers 8 and the flow passage 9. The fluid is compressed stepwise by centrifugal force of the impellers 8 when passing through the multi-stage impellers 8. The compressed fluid after passing through the last-stage impeller 8A disposed on the furthest downstream side among the multi-stage impellers 8 is discharged from the centrifugal compressor 1 through the scroll flow passage 30 and the discharge port 18.

A through portion of the casing head 5, 6, into which the shaft 4 is inserted, may be provided with a shaft seal device to prevent leakage of the fluid via the through portion. In the embodiment shown in FIG. 1, a shaft seal device 26 is disposed on the casing head 6 on the intake port 16 side.

As shown in FIG. 1, the plurality of diaphragms 10 includes a first diaphragm 12 having a surface which forms the scroll flow passage 30 and a second diaphragm 14 disposed adjacent to the first diaphragm 12 in the axial direction.

Figure 3:
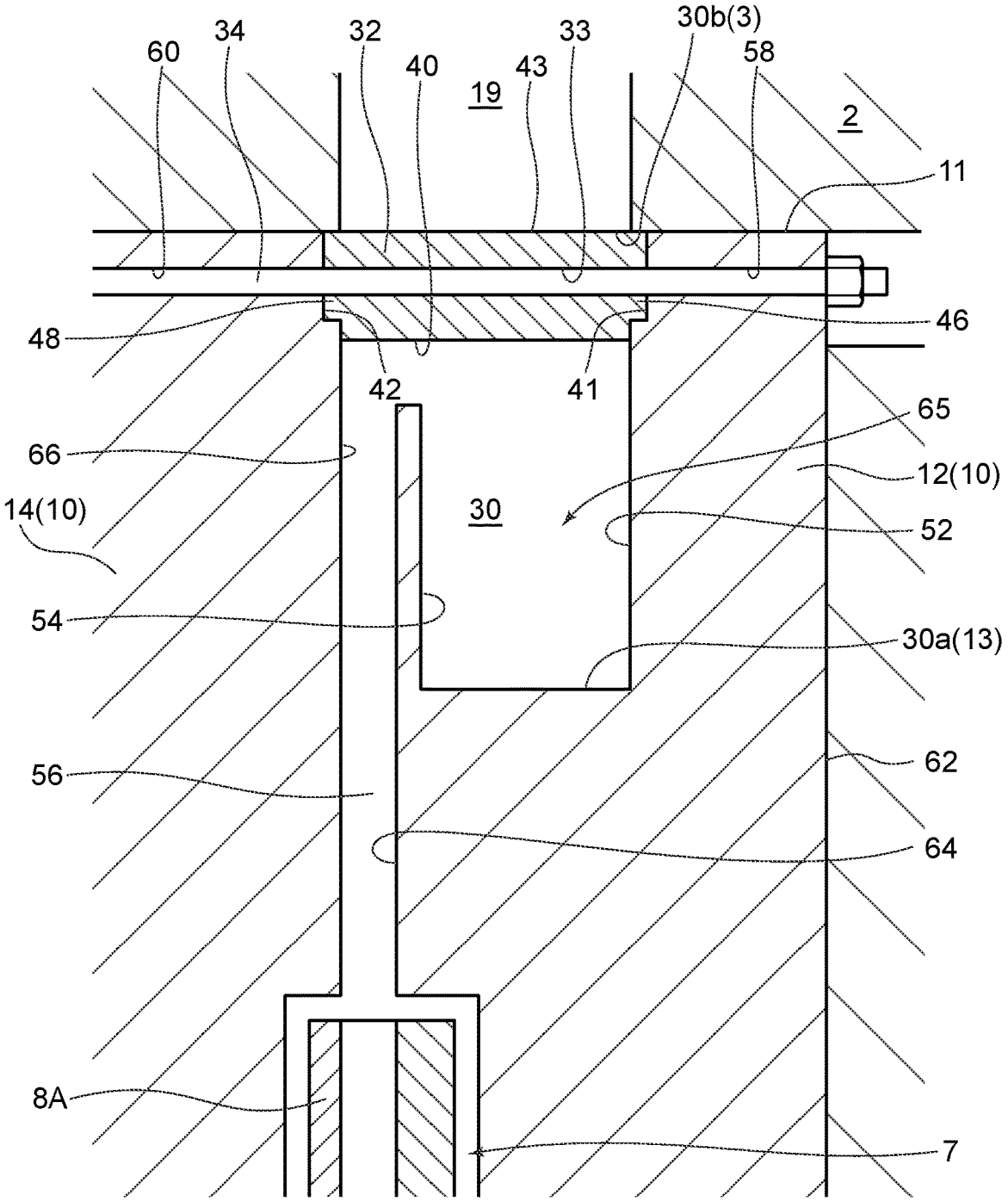
FIG. 3 is an enlarged view of the cross-section of the centrifugal compressor shown in FIG. 1 in the vicinity of a first diaphragm and a second diaphragm.

FIG. 3 is an enlarged view of the cross-section of the centrifugal compressor 1 shown in FIG. 1 in the vicinity of the first diaphragm 12 and the second diaphragm 14.

In the embodiment shown in FIGS. 1 to 3, the first diaphragm 12 and the second diaphragm 14 are fastened and connected with a bolt 34. Each of the first diaphragm 12 and the second diaphragm 14 has a bolt hole 58, 56 with female thread (see FIG. 3). The bolt 34 is screwed into the bolt holes 58, 56 and thereby fastens the first diaphragm 12 and the second diaphragm 14.

In the embodiment shown in FIGS. 1 to 3, an axial spacer 32 disposed between the first diaphragm 12 and the second diaphragm 14 includes a bolt insertion hole 33 with female thread (see FIG. 3). By screwing the bolt 34 into the bolt holes 58, 60 and the bolt insertion hole 33, the first diaphragm 12 and the second diaphragm 14 are fastened in a state that the axial spacer 32 is interposed between the first diaphragm 12 and the second diaphragm 14.

In some embodiments, the first diaphragm 12 and the second diaphragm 14 may be connected by welding.

The diaphragms 10 other than the first diaphragm 12 and the second diaphragm 14 may be connected by welding.

The first diaphragm 12 has a first end surface 62 and a second end surface 64 which are opposite surfaces in the axial direction. The first end surface 62 is an end surface adjacent to the casing head 5 disposed on the discharge port 18 side. The second end surface 64 is an end surface adjacent to the second diaphragm 14. Additionally, a recess 65 recessed radially inward from an outer peripheral surface 11 of the first diaphragm 12 is formed in an axial position range between the first end surface 62 and the second end surface 64. The recess 65 has a pair of side surfaces 52, 54 along the radial direction and a bottom surface 13 along the circumferential direction. That is, the bottom surface 13 is a surface positioned on the radially inner side of the outer peripheral surface 11.

As shown in FIGS. 2 and 3, the scroll flow passage 30 is formed by a scroll inner peripheral wall 30*a*, which is a wall surface on the radially inner side, and a scroll outer peripheral wall 30*b*, which is a wall surface on the radially outer side. The scroll inner peripheral wall 30*a* is formed by the bottom surface 13 of the recess 65 of the first diaphragm 12 (a surface of the first diaphragm positioned on the radially inner side of the outer peripheral surface 11); at least a part of the scroll outer peripheral wall 30*b* is formed by an inner peripheral surface 3 of the casing 2.

Although details will be described below, in the illustrated embodiment, the scroll outer peripheral wall 30*b* is formed by the inner peripheral surface 3 of the casing 2 and an inner peripheral surface (spacer inner peripheral surface 40) of the axial spacer 32.

In the illustrated embodiment, the pair of side surfaces 52, 54 of the recess 65 of the first diaphragm 12 each forms a wall surface, along the radial direction, of the scroll flow passage 30.

Figure 6:
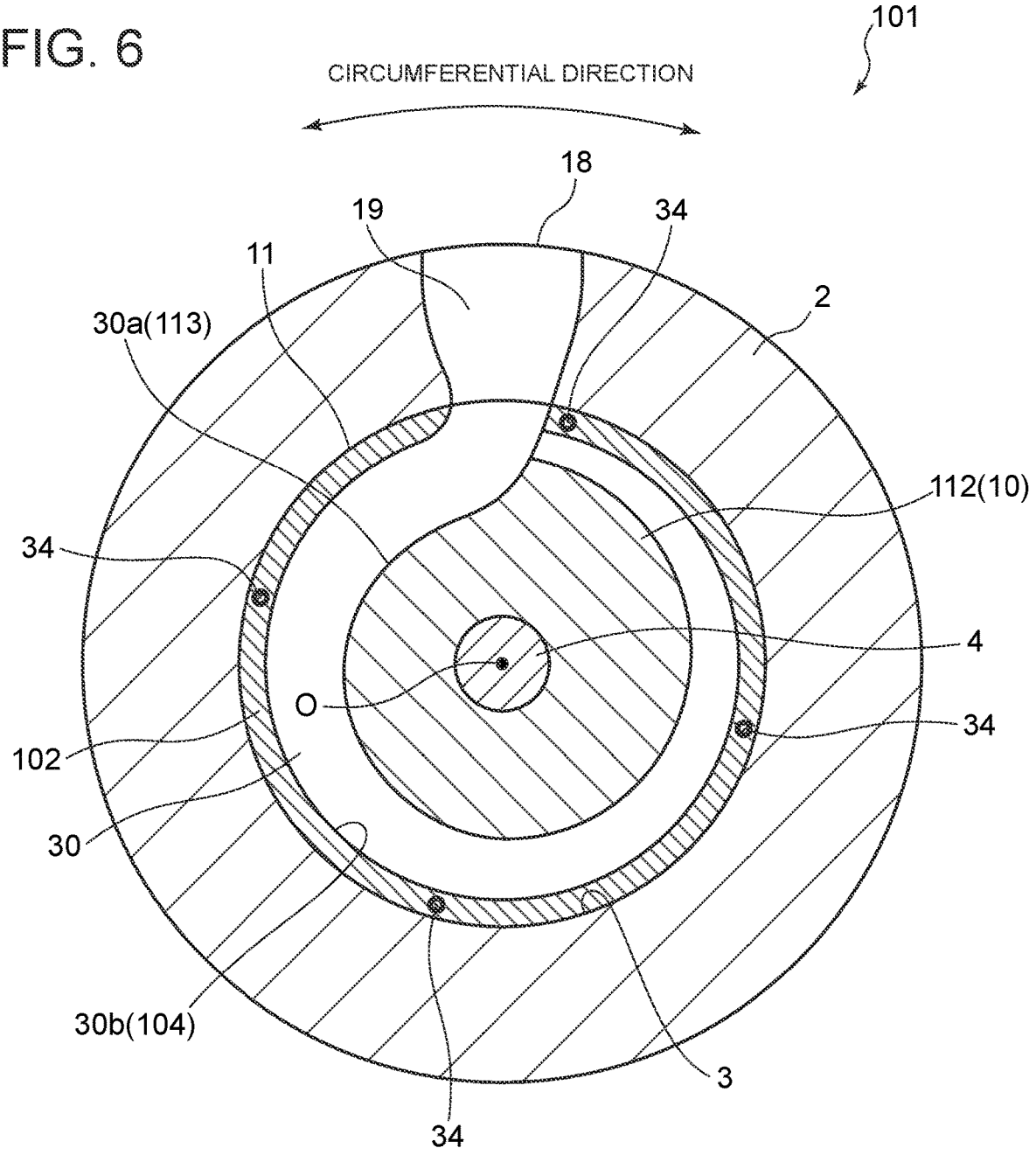
FIG. 6 is an exemplary cross-sectional view of a conventional centrifugal compressor, taken along the radial direction.

FIG. 6 is an exemplary cross-sectional view of a conventional centrifugal compressor, taken along the radial direction (cross sectional view corresponding to FIG. 2).

In the conventional centrifugal compressor 101 shown in FIG. 6, the scroll inner peripheral wall 30*a* of the scroll flow passage 30 is formed by a surface 113 of a diaphragm 112, and the scroll outer peripheral wall 30*b* is formed by an inner peripheral surface 104 of an annular spacer 102 disposed between the diaphragm 112 and a diaphragm arranged adjacent to the diaphragm 112.

The inner peripheral surface 104 of the annular spacer 102 is positioned on the relatively radially inner side, compared with the inner peripheral surface 3 or the like of the casing 2. Accordingly, when the scroll outer peripheral wall 30*b* is formed by the inner peripheral surface 104 of the annular spacer 102 as described above, the scroll outer peripheral wall 30*b* must be disposed on the relatively radially inner side. Therefore, it is difficult to ensure a sufficient flow passage area of the scroll flow passage 30 while avoiding an increase in size of the compressor, and friction loss is relatively increased with an increase in scroll cross-sectional flow rate.

By contrast, in the illustrative embodiment shown in FIGS. 1 to 3, since at least a part of the scroll outer peripheral wall 30*b* is formed by the inner peripheral surface 3 of the casing 2, the scroll outer peripheral wall 30*b* can be disposed on the relatively radially outer side, compared with a case where the scroll outer peripheral wall 30*b* is formed by the inner peripheral surface 104 of the annular spacer 102 as shown in FIG. 6, for instance. Consequently, it is possible to enlarge the scroll flow passage area and reduce the scroll cross-sectional flow rate without increasing the casing 2, and it is possible to reduce friction loss in the scroll flow passage 30. Thus, it is possible to reduce fluid loss in the scroll flow passage 30 while suppressing an increase in size of the centrifugal compressor 1.

As shown in FIGS. 1 to 3, the axial spacer 32 is disposed between the first diaphragm 12 and the second diaphragm 14. Placement of the axial spacer 32 enables positioning of the first diaphragm in the axial direction, relative to the second diaphragm.

Further, in the embodiment shown in FIGS. 1 to 3, multiple axial spacers 32 (four axial spacers 32 in the illustrated example) are arranged in the circumferential direction. This ensures positioning of the first diaphragm in the axial direction, relative to the second diaphragm.

The axial spacer 32 is disposed between the first diaphragm 12 and the second diaphragm 14 in the axial direction; however, the axial spacer 32 is not necessarily exposed to the scroll flow passage 30.

For instance, in the illustrative embodiment shown in FIGS. 1 to 3, the axial spacer 32 is disposed, in a radially outer end portion of the first diaphragm 12, between the side surface 52 facing the second diaphragm 14 among the pair of side surfaces 52, 54 of the recess 65 of the first diaphragm 12 and an end surface 66 facing the first diaphragm 12 among both axial end surfaces of the second diaphragm 14. That is, the axial spacer 32 is disposed so as to be exposed to the scroll flow passage 30.

In another embodiment, the axial spacer 32 may be disposed between an end surface of the first diaphragm 12 and an end surface of the second diaphragm 14 which are facing each other (i.e., the second end surface 64 of the first diaphragm 12 and the end surface 66 of the second diaphragm 14). That is, the axial spacer 32 may be disposed in a diffuser passage 56 positioned downstream of the last-stage impeller 8A. In this case, the axial spacer 32 is not exposed to the scroll flow passage 30.

The inner peripheral surface 3 of the casing 2, which forms the scroll outer peripheral wall 30*b*, may have a cylindrical shape whose axis coincides with the rotational center (rotational axis O) of the centrifugal compressor 1.

When the inner peripheral surface 3 of the casing 2, which forms the scroll outer peripheral wall 30*b*, has a cylindrical shape whose axis coincides with the rotational center of the centrifugal compressor 1, the scroll flow passage 30 can be easily formed by using the cylindrical inner peripheral surface 3.

That is, it is possible to form the scroll outer peripheral wall 30*b* by the simple cylindrical shape of inner peripheral surface 3 of the casing 2 while the scroll inner peripheral wall 30*a* is formed by the bottom surface 13 (surface) of the recess 65 of the first diaphragm 12. Consequently, it is possible to relatively easily form the scroll flow passage 30 without processing the casing 2 into a complicated flow passage shape.

Further, since the inner peripheral surface 3 of the casing 2, which forms the scroll outer peripheral wall 30*b*, has a cylindrical shape whose axis coincides with the rotational axis O of the centrifugal compressor 1 and thus is concentric with the rotor 7, the structure of the centrifugal compressor 1 can be simplified.

Figure 4:
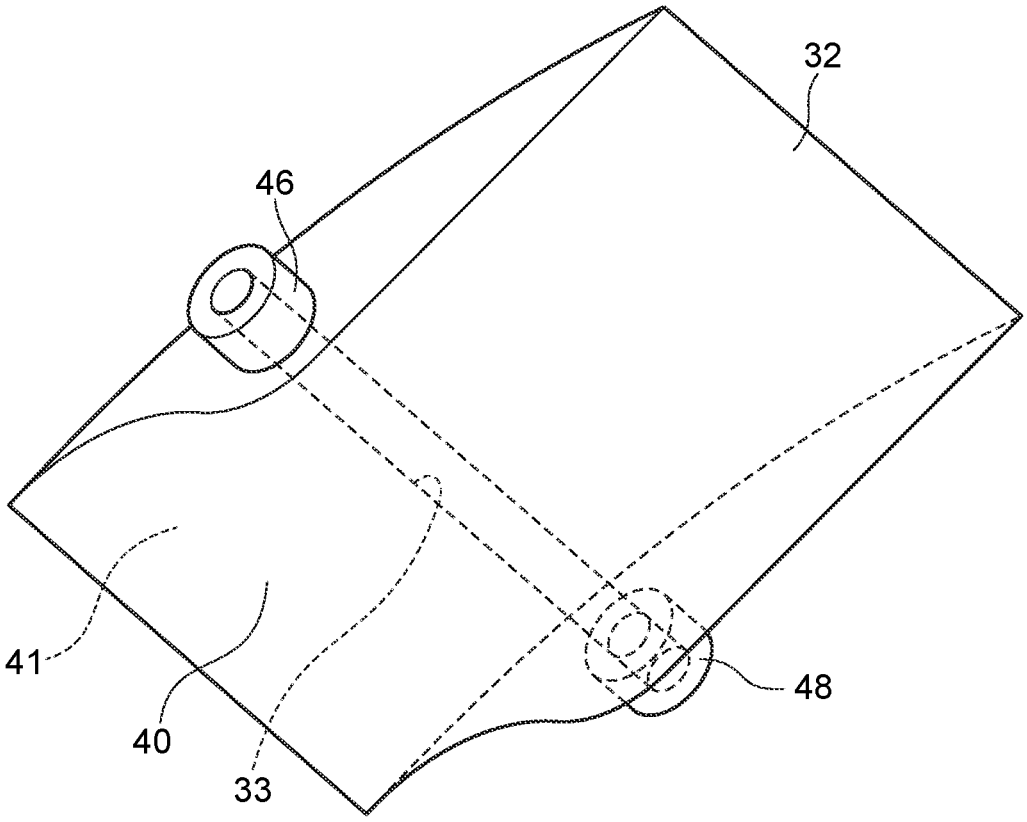
FIG. 4 is a perspective view of an axial spacer according to an embodiment.
Figure 5:
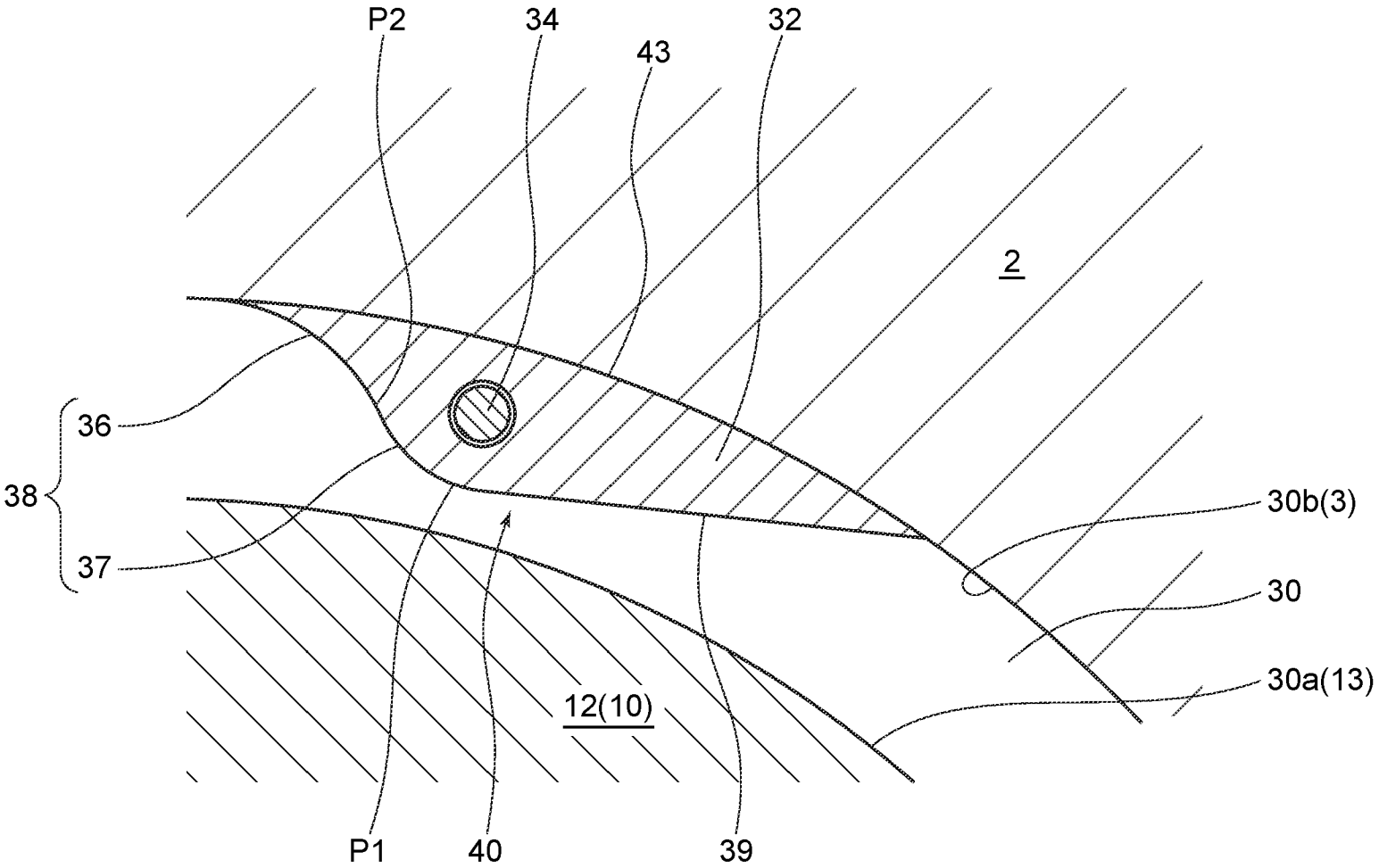
FIG. 5 is an enlarged view of the cross-section shown in FIG. 2 in the vicinity of an axial spacer 32.

FIG. 4 is a perspective view of the axial spacer 32 according to an embodiment. FIG. 5 is an enlarged view of the cross-section shown in FIG. 2 in the vicinity of the axial spacer 32.

As shown in FIGS. 4 and 5, the axial spacer 32 has a spacer inner peripheral surface 40 facing the scroll inner peripheral wall 30*a* and a spacer outer peripheral surface 43 facing the inner peripheral surface 3 of the casing 2.

As described above, the scroll outer peripheral wall 30*b* may be formed by the spacer inner peripheral surface 40 of the axial spacer 32 and the inner peripheral surface 3 of the casing 2.

In this case, in some embodiments, as shown in FIG. 5, the spacer inner peripheral surface 40 includes an upstream contour portion 38 and a downstream contour portion 39 positioned downstream of the upstream contour portion 38 in a scroll flow in the scroll flow passage 30. The upstream contour portion 38 is provided so as to adjoin the inner peripheral surface 3 of the casing 2, and the downstream contour portion 39 is connected to the upstream contour portion 38 at point P1 located on a radially innermost portion of the axial spacer 32.

In this case, since the scroll outer peripheral wall 30*b* is formed so that the inner peripheral surface 3 of the casing 2 and the spacer inner peripheral surface 40 of the axial spacer 32 are connected, it is possible to suppress turbulence of fluid in the scroll flow passage 30, compared with a case where the inner peripheral surface 3 of the casing 2 and the surface of the axial spacer 32 is not connected. Thus, it is possible to effectively reduce fluid loss in the scroll flow passage 30.

As shown in FIG. 5, the upstream contour portion 38 may include a first curved surface 36 curved radially outward and a second curved surface 37 positioned downstream of the first curved surface 36 in the scroll flow and curved radially inward. In the illustrative embodiment shown in FIG. 5, the first curved surface 36 and the second curved surface 37 are connected at point P2.

In this case, the inner peripheral surface 3 of the casing 2 and the spacer inner peripheral surface 40 forming the scroll outer peripheral wall 30*b* are smoothly connected via the first curved surface 36 and the second curved surface 37. Thus, it is possible to more effectively suppress turbulence of fluid in the scroll flow passage 30. Consequently, it is possible to more effectively reduce fluid loss in the scroll flow passage.

Additionally, as shown in FIG. 5, the downstream contour portion 39 may be at least partially formed by a straight line which extends obliquely with respect to the circumferential direction, radially outward downstream in the scroll flow. In the illustrative embodiment shown in FIG. 5, the entire downstream contour portion 39 is formed by a straight line.

In this case, since the downstream contour portion 39 includes a straight-line portion which extends obliquely with respect to the circumferential direction and radially outward downstream in the scroll flow, processing and manufacturing of the axial spacer 32 can be easily controlled, and it is possible to suppress turbulence of fluid in the scroll flow passage 30. Thus, it is possible to reduce fluid loss in the scroll flow passage 30 while improving manufacturability of the centrifugal compressor 1.

As described above, in some embodiments, the first diaphragm 12 and the second diaphragm 14 are connected with the bolt 34. In this case, for instance as shown in FIGS. 3 and 4, each of the axial spacers 32 may include the bolt insertion hole 33 for the bolt 34.

In this case, the bolt 34 for connecting the first diaphragm 12 and the second diaphragm 14 is inserted into the bolt insertion hole 33 of the axial spacer 32. Thus, the bolt 34 disposed on the radially inner side of the inner peripheral surface 3 of the casing 2 to connect the diaphragms is covered with the axial spacer 32 without being exposed to the scroll flow passage 30. Accordingly, the bolt 34 itself does not cause turbulence of fluid flowing in the scroll flow passage 30. Thus, it is possible to effectively reduce fluid loss in the scroll flow passage 30.

In some embodiments, each of the axial spacers 32 may include fitting portions, on both axial ends, fitted into the first diaphragm 12 and the second diaphragm 14, respectively.

For instance, the axial spacer 32 shown in FIGS. 3 and 4 includes a first fitting portion 46 fitted into a first recess 41 provided in the first diaphragm 12 at one end in the axial direction and a second fitting portion 48 fitted into a second recess 42 provided in the second diaphragm 14 at another end in the axial direction. The first recess 41 of the first diaphragm 12 is provided in the side surface 52 of the recess 65 of the first diaphragm 12, and the second recess 42 of the second diaphragm 14 is provided in the end surface 66 of the second diaphragm 14.

In this case, each of the axial spacers 32 includes the first fitting portion 46 fitted into the first recess 41 provided in the first diaphragm 12 and the second fitting portion 48 fitted into the second recess 42 provided in the second diaphragm 14. This facilitates positioning of each axial spacer 32 in the circumferential direction or the radial direction around the axis.

In the radial cross-section shown in FIG. 2, P3 is a point on the furthest downstream portion of the scroll outer peripheral wall 30*b* in the scroll flow. L1 is a straight line passing through the rotational axis O and the center point of the discharge port 18 provided in the casing 2. L2 is a straight line passing through the rotational axis O and perpendicular to the straight line L1. L3 is a straight line passing through the rotational axis O and the point P3. P4 is a point closest to the point P3 in an extension range of the discharge port 18 on the outer peripheral surface of the casing 2 (see FIG. 2).

In some embodiments, a distance D1 between the position of the point P3 and the position of the point P4 in the direction of the straight line L2 is more than zero.

Alternatively, in some embodiments, an angle A1 (see FIG. 2) between the straight lines L1 and L3 is larger than an angle A2 (see FIG. 2) between the straight lines L2 and L3.

In this case, it is possible to ensure a large flow passage area of the scroll flow passage 30 in the vicinity of the discharge port 18. Thus, it is possible to reduce fluid loss in the scroll flow passage while effectively suppressing an increase in size of the centrifugal compressor 1.

In some embodiments, a part of the scroll outer peripheral wall 30*b* is formed by the inner peripheral surface 3 of the casing 2, and another part of the scroll outer peripheral wall 30*b* is formed by the spacer inner peripheral surface 40 of at least one axial spacer 32. In the radial cross-section (e.g., cross-section shown in FIG. 2), a total circumferential length of a part of the scroll outer peripheral wall 30*b* formed by the inner peripheral surface 3 of the casing 2 is longer than a total circumferential length of a part of the scroll outer peripheral wall 30*b* formed by the spacer inner peripheral surface 40.

In this case, since half or more than half part of the scroll outer peripheral wall 30*b* is formed by the inner peripheral surface 3 of the casing 2, a large flow passage area of the scroll flow passage 30 can be easily obtained. Thus, it is possible to reduce fluid loss in the scroll flow passage while effectively suppressing an increase in size of the centrifugal compressor 1.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

The invention claimed is:

1. A centrifugal compressor comprising:

a plurality of diaphragms including a first diaphragm and a second diaphragm which are adjacent to each other in an axial direction;

a casing disposed on a radially outer side of the plurality of diaphragms and accommodating internal components including the plurality of diaphragms;

one or more axial spacers disposed between the first diaphragm and the second diaphragm; and a scroll flow passage formed by a scroll inner peripheral wall and a scroll outer peripheral wall, the scroll inner peripheral wall being formed by a surface of the first diaphragm positioned on a radially inner side of an outer peripheral surface of the first diaphragm, at least a part of the scroll outer peripheral wall being formed by an inner peripheral surface of the casing, the scroll flow passage having a flow-passage cross-sectional area changing along a circumferential direction, wherein the first diaphragm has a recess that is recessed radially inward from the outer peripheral surface of the first diaphragm, and wherein the surface of the first diaphragm forming the scroll inner peripheral wall includes a bottom surface of the recess.

2. The centrifugal compressor according to claim 1, wherein the one or more axial spacers comprise two or more axial spacers disposed in the circumferential direction on a radially inner side of the inner peripheral surface of the casing.

3. The centrifugal compressor according to claim 1, further comprising at least one bolt for connecting the first diaphragm and the second diaphragm, wherein each of the one or more axial spacers includes a bolt insertion hole for the at least one bolt.

4. The centrifugal compressor according to claim 1, wherein each of the one or more axial spacers includes:

a first fitting portion fitted into a first recess provided in the first diaphragm at one end; and a second fitting portion fitted into a second recess provided in the second diaphragm at another end.

5. The centrifugal compressor according to claim 1, wherein the inner peripheral surface, forming the scroll outer peripheral wall, of the casing has a cylindrical shape whose axis is a rotational center of the centrifugal compressor.

6. A centrifugal compressor, comprising:

a plurality of diaphragms including a first diaphragm and a second diaphragm which are adjacent to each other in an axial direction;

a casing disposed on a radially outer side of the plurality of diaphragms and accommodating internal components including the plurality of diaphragms;

one or more axial spacers disposed between the first diaphragm and the second diaphragm; and a scroll flow passage formed by a scroll inner peripheral wall and a scroll outer peripheral wall, the scroll inner peripheral wall being formed by a surface of the first diaphragm positioned on a radially inner side of an outer peripheral surface of the first diaphragm, at least a part of the scroll outer peripheral wall being formed by an inner peripheral surface of the casing, the scroll flow passage having a flow-passage cross-sectional area changing along a circumferential direction, wherein the one or more axial spacers comprise two or more axial spacers disposed in the circumferential direction on a radially inner side of the inner peripheral surface of the casing, wherein each of the two or more axial spacers has a spacer inner peripheral surface facing the scroll inner peripheral wall, wherein the spacer inner peripheral surface includes:

an upstream contour portion adjoining the inner peripheral surface of the casing; and a downstream contour portion positioned downstream of the upstream contour portion in a scroll flow and connected to the upstream contour portion at a point located on a radially innermost portion of each of the plurality of axial spacers, and wherein the scroll outer peripheral wall is formed by the spacer inner peripheral surface of each of the two or more axial spacers and the inner peripheral surface of the casing.

7. The centrifugal compressor according to claim 6, wherein the upstream contour portion includes:

a first curved surface curved radially outward; and a second curved surface positioned downstream of the first curved surface in the scroll flow and curved radially inward.

8. The centrifugal compressor according to claim 6, wherein the downstream contour portion includes a straight-line portion extending obliquely with respect to a circumferential direction and radially outward downstream in the scroll flow.

* * * * *